United States Patent [19]

Schütz

[11] Patent Number: 4,776,479

[45] Date of Patent: Oct. 11, 1988

[54] SPIGOTED BARREL

[76] Inventor: Udo Schütz, Rückersteg 4, D-5418 Selters, Fed. Rep. of Germany

[21] Appl. No.: 92,410

[22] Filed: Sep. 1, 1987

[30] Foreign Application Priority Data

Nov. 22, 1986 [DE] Fed. Rep. of Germany ... 8631318[U]

[51] Int. Cl.[4] ..... B65D 25/38

[52] U.S. Cl. ..... 220/5 R; 220/DIG. 1; 220/DIG. 6

[58] Field of Search ..... 220/5 R, 465, DIG. 1, 220/DIG. 6

[56] References Cited

U.S. PATENT DOCUMENTS

| | | | |
|---|---|---|---|
| 1,178,717 | 4/1916 | Hackney | 220/DIG. 1 |
| 2,107,992 | 2/1938 | Schultz | 220/465 |
| 2,124,565 | 7/1938 | Goll et al. | 220/465 |
| 2,146,381 | 2/1939 | Rheem | 220/DIG. 1 |
| 3,098,496 | 7/1963 | Milbourne | 220/465 |
| 3,170,586 | 2/1965 | Bulgrin | 220/5 R |
| 3,987,926 | 10/1976 | Yavorsky | 220/DIG. 1 |
| 4,557,406 | 12/1985 | Olinger | 220/DIG. 6 |

*Primary Examiner*—Jimmy G. Foster

*Attorney, Agent, or Firm*—Young & Thompson

[57] ABSTRACT

In a spigoted barrel of a synthetic resin, welded together from two or more parts, with a sidewall section, a head section, and a lid section, exhibiting bungholes (e.g. 9) hidden in depressions, a barrier (13) is integrally molded to the inner surface (12) of each depression (e.g. 11) of the lid section (4), this barrier extending in an arcuate shape from the sidewall section (14) around the respective bunghole (9) and constituting a collecting pan for a residual content (16) of the barrel. Thereby, upon tilting of the barrel, complete emptying becomes possible. The barrier (13) is lower in the zone around the bunghole (9) than in the regions toward the sidewall section (14) so that the barrier (13) does not form a hindrance during cleaning of the barrel.

2 Claims, 3 Drawing Sheets

SPIGOTED BARREL

Figure 1:
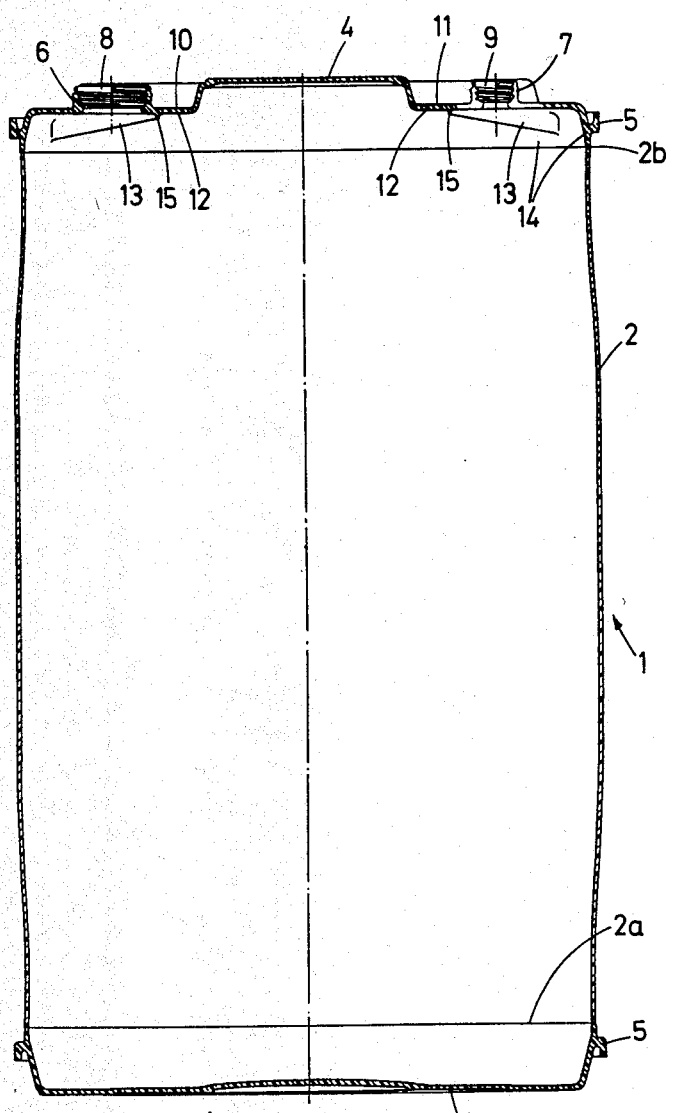

The invention relates to a spigoted barrel of the type set forth in the preamble of claim 1.

In spigoted barrels of this type, complete emptying of the content is impossible due to the arrangement of the bungs which are recessed for their protection, because this residue collects upon tilting of the barrel at the lid section around the inwardly protruding depressions and therefore cannot flow out of the bungholes.

The invention is based on the object of fashioning the spigoted barrel of the aforementioned type so that complete emptying thereof is possible.

This object has been attained according to the invention by the characterizing features of claim 1. A suitable further development forms the subject of claim 2.

The novel spigoted barrel, due to the collecting pan formed by the barrier, can be emptied down to the last drop of a liquid content, because during tilting of the barrel this residual content is positively guided by the barrier toward the bunghole and cannot run laterally past the indentations, which latter project upwardly with the barrel being tilted, into the then lower-disposed partial zones of the lid.

Figure 2:
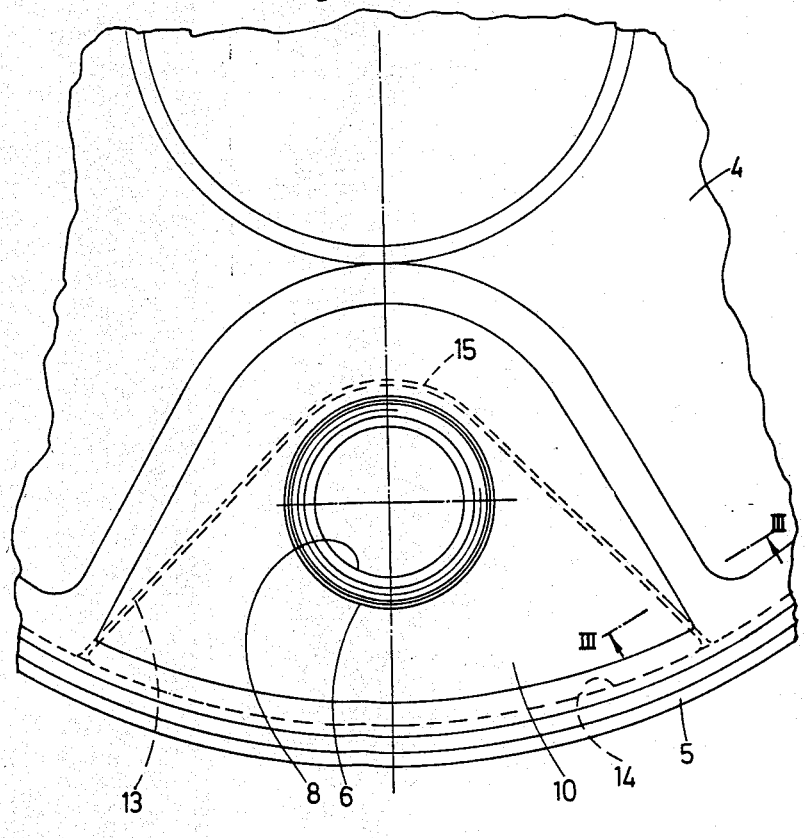
Figure 3:
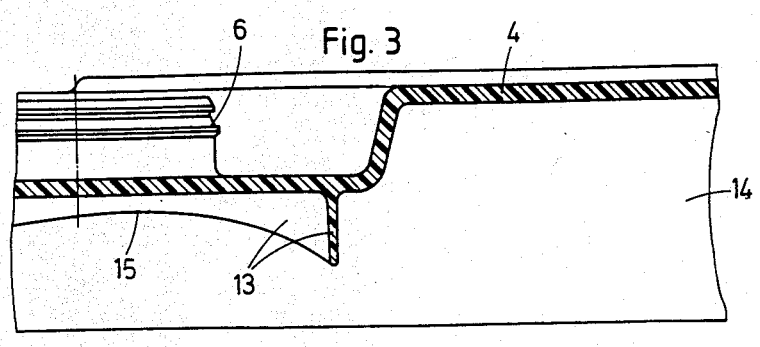
Figure 4:
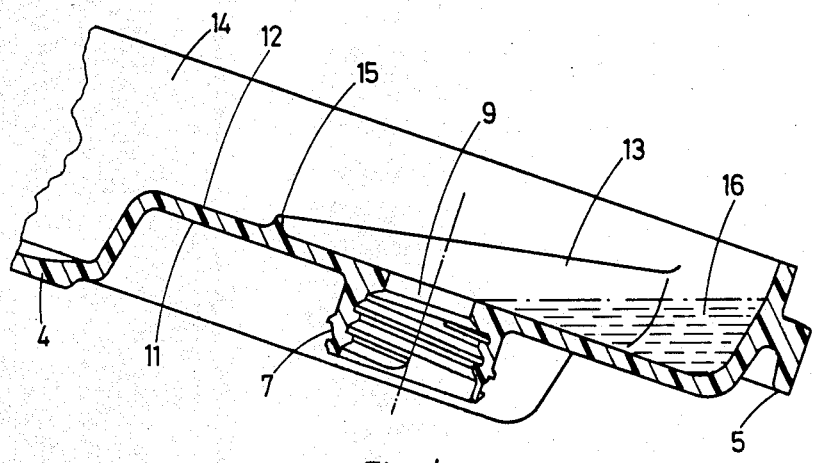

One embodiment of the invention is illustrated in the drawings wherein:

FIG. 1 is a longitudinal section through the spigoted barrel according to the invention, FIG. 2 shows a partial top view in the zone of a bunghole, FIG. 3 shows an enlarged sectional view along line III—III in FIG. 2, and FIG. 4 shows a partial sectional view in the zone of a bung with the barrel being tilted.

The illustrated spigoted barrel (1) consists of a sidewall section (2), a head section (3), and a lid section (4), all of which consist of a synthetic resin, the head section (3) and the lid section (4) being parts injection-molded from synthetic resin whereas the sidewall section (2) can be made in some other way, for example by blow molding or extrusion. The head and lid sections (3, 4) are provided with circumferential rings (5) and are welded to the sidewall section at (2*a*) and, respectively, (2*b*). The head section (3) can also be fashioned integrally with the sidewall section (2).

The lid section (4) exhibits two integrally formed bungs (6, 7) located in diametrical opposition to each other; these bungs can be designed for a screw closure and constitute bungholes (8, 9) that can be sealed by means of appropriate screw plugs (not illustrated). The bungs (6, 7) are arranged, for their protection, in depressions (10, 11) of the lid section (4).

On the inside surface (12) of each of the depressions (10, 11), a barrier (13) is integrally formed; this barrier emanates from a rim (14) of the lid section (4) passing over into the sidewall section (2) and extends in an arcuate shape around the respective bunghole (8, 9). In the arcuate region (15) of the barrier (13), the latter is lower, and its height rises up to the rim (14) of the lid section (4) in a gradual fashion, as can be seen particularly clearly from FIG. 4 illustrating a radial section through the lid section (4) in the zone of the bung (7), the barrel (1) being tilted for complete emptying.

In FIG. 4, a small residue (16) of the barrel content is shown, and it can clearly be seen that this residue (16) during further tilting of the barrel (1) is retained by the barrier (13) and is conducted to the bunghole (9) so that this residue (16) cannot flow back again into the zones which, when the barrel (1) is tilted or tipped over, are then located at a lower level beside the then high-level indentation (11). In case of a relatively large residue (16), it may happen, of course, that upon the initial tilting of the barrel (1) a portion of the residue (16) still spills over the barrier (13). However, after a second tilting of the barrel (1), the final residue (16) of the barrel content is presumably emptied out, so that thereby environmental damage or other injuries that could arise from the residue of the barrel content are avoided. Besides, the inside cleaning of the barrel (1) is easier, and in order to prevent impeding of this cleaning step by the barrier (13), the latter is designed to be lower in the arcuate zone (15) in the proximity of the bunghole (8) or (9).

I claim:

1. Spigoted barrel of a synthetic resin, welded together from two or more parts, with a sidewall section, a head section, and a lid section, which latter exhibits bungholes hidden in depressions, characterized in that a barrier (13) is integrally molded to the inner surface (12) of each depression (10, 11) of the lid section (4), this barrier extending in an arcuate shape from the sidewall section (2, 14) around the respective bunghole (8, 9) and constituting a collecting pan for a residual content (16) of the barrel (1).

2. Spigoted barrel according to claim 1, characterized in that the barrier (13), in the zone around the bunghole (8 and 9, respectively), is lower than in the zones toward the sidewall section (2).

* * * * *